United States Patent [19]

Gaskell

[11] 4,394,971

[45] Jul. 26, 1983

[54] FUEL INJECTION NOZZLE ASSEMBLY

[75] Inventor: David J. Gaskell, Sudbury, England

[73] Assignee: Lucas Industries Limited, Birmingham, England

[21] Appl. No.: 240,547

[22] Filed: Mar. 4, 1981

[51] Int. Cl.[3] ..... F02M 61/08

[52] U.S. Cl. ..... 239/453; 403/353

[58] Field of Search ..... 403/353; 285/325, 317; 239/452, 453, 456, 459, 533.12

[56] References Cited

U.S. PATENT DOCUMENTS

| | | | |
|---|---|---|---|
| 2,555,803 | 6/1951 | Mashinter et al. | 239/453 |
| 3,690,566 | 9/1972 | Krauss et al. | 239/453 |
| 4,014,195 | 3/1977 | Grogan et al. | 403/353 X |

FOREIGN PATENT DOCUMENTS

| | | | |
|---|---|---|---|
| 839831 | 4/1939 | France | 239/453 |

*Primary Examiner*—Andres Kashnikow

[57] ABSTRACT

A fuel injection nozzle assembly includes an outwardly opening valve member having a stem about which is located a spring abutment engaged by a spring. The stem is provided with an enlarged portion adjacent a reduced portion and a collar abuts against the abutment. The collar has an aperture in which is defined a recessed part annular shoulder which is engaged by the enlarged portion of the stem. The collar has a further aperture which breaks into the recessed aperture, the further aperture being large enough to allow the enlarged portion to pass therethrough and the gap defined between apertures is large enough to allow the reduced portion of the stem to be passed therethrough.

1 Claim, 7 Drawing Figures

FUEL INJECTION NOZZLE ASSEMBLY

This invention relates to a fuel injection nozzle assembly for use in a fuel injection nozzle for an internal combustion engine, the nozzle assembly comprising a body portion defining a bore having a seating at one end thereof, a valve member having a stem portion extending through the bore, a head located at one end of the stem for co-operation with said seating, a spring abutment located about said stem, a coiled compression spring positioned between said abutment and said body portion and means for retaining the abutment relative to the stem whereby the force exerted by the spring urges the valve head into contact with the seating.

The object of this invention is to provide a nozzle assembly of the kind specified in a simple and convenient form.

According to the invention in a nozzle assembly of the kind specified the means for retaining the abutment relative to the stem comprises an enlarged portion on said stem, a collar having a first aperture extending therethrough and through which can pass the enlarged portion of the stem, a second aperture which breaks into said first aperture and which can accommodate a reduced portion of the stem, said apertures defining a gap through which can pass the reduced portion of the stem, and a part annular shoulder defined by and recessed in said second aperture said shoulder being engaged by a surface defined on said enlarged portion of the stem, said collar being engaged by said spring abutment.

Figure 1:
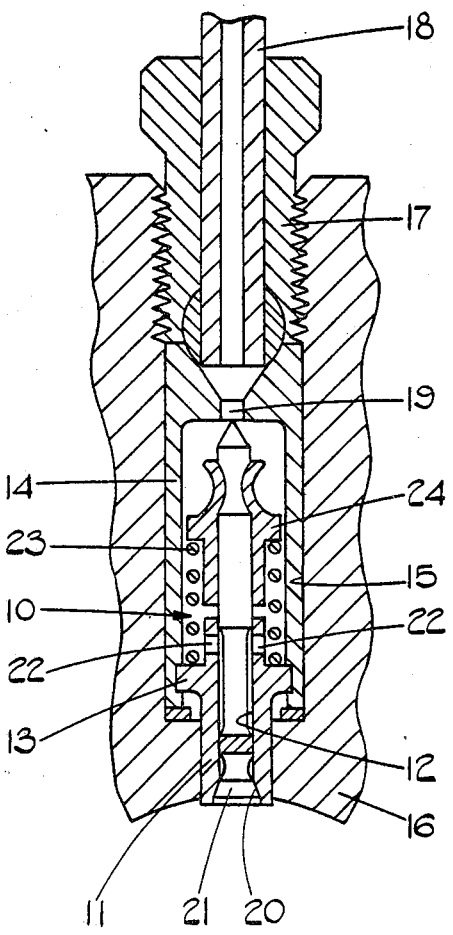
FIG. 1. PRIOR ART
Figure 2:
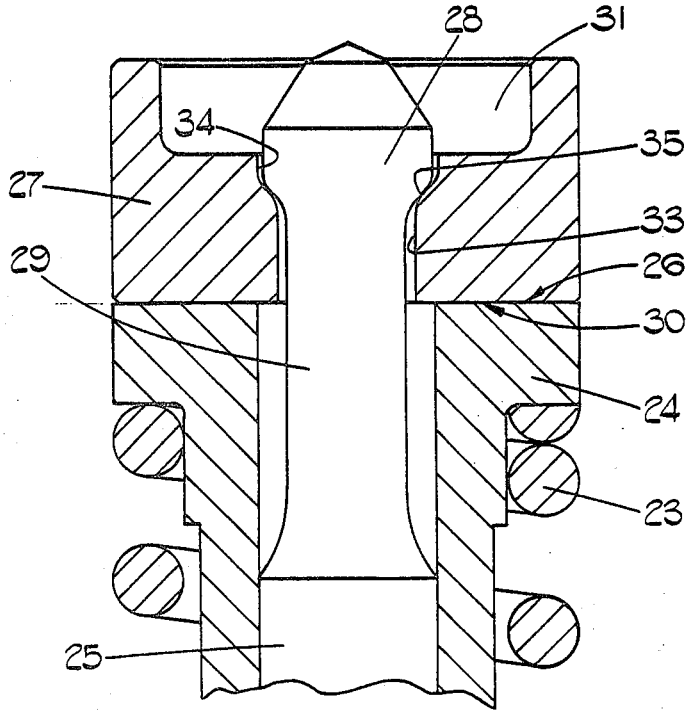
Figure 3:
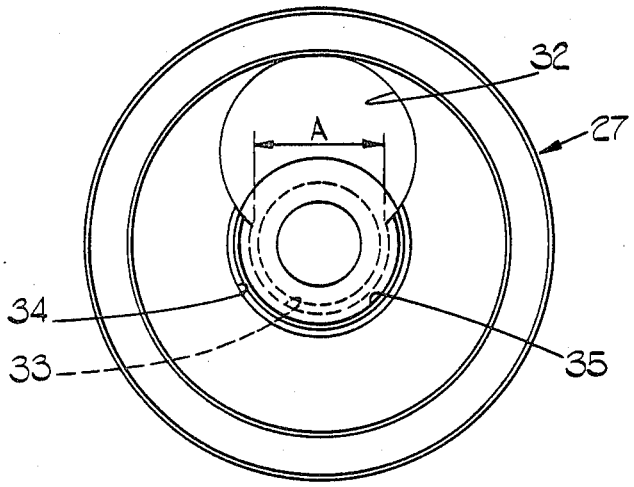

Examples of nozzle assembly in accordance with the invention will now be described with reference to the accompanying drawings in which:

FIG. 1 shows an example of a nozzle assembly known in the art, shown mounted in a housing and located in the cylinder head of an internal combustion engine. FIGS. 2 and 3 show side elevations and plan views respectively of part of the nozzle assembly in accordance with the invention, and FIGS. 4, 5 and 6, and 7 are views corresponding to FIGS. 2 and 3 showing further examples.

Referring to FIG. 1 of the drawings a nozzle assembly is shown generally at 10 and it includes a body portion 11 having a bore 12 extending therethrough. The body portion is of generally cylindrical form and it is provided with a flange 13 which is retained in the groove defined in a surrounding housing 14. The housing 14 is in use and as shown, located in a bore 15 formed in the cylinder head 16 of an internal combustion engine, the bore 15 being of stepped form so that the end of the body portion 11 remote from the housing, extends to the combustion space of the associated engine. Conveniently, and as shown, the housing is retained in the bore by means of a nut 17 which is in screw thread engagement with the bore, the nut 17 also acting to retain a fuel supply pipe 18 relative to the housing 14, the housing having an opening 19 through which fuel from the pipe can enter the space defined in the housing and which is occupied by part of the valve assembly 10.

At the end of the bore 12 adjacent the combustion space, there is formed a seating 20 with which can cooperate the head 21 of a valve member which is axially slidable in the bore 12. The stem of the valve member within the bore 12 is of reduced diameter and also has a fluted guide portion whereby fuel can flow in the open position of the valve member, from the interior of the housing by way of ports 22 into the combustion chamber of the engine.

The valve member is biassed by a coiled compression spring 23, which at one end engages the body 11 and at the other end engages a spring abutment 24 which has a portion which is deformed into a reduced portion of the stem of the valve member. In operation, when fuel under pressure is applied to the interior of the housing, the fuel under pressure acts upon the valve member in opposition to the force exerted by the spring and when this force is sufficient the valve member is moved to the open position to permit flow of fuel between the head and the seating. As explained, the construction described is known in the art.

The method of retaining the abutment on the valve stem as shown in FIG. 1, is inconvenient and not sufficiently reliable. Turning now to the remaining Figures, the stem of the valve member is indicated at 25 with the abutment 24 having a flat surface 26 for engagement by a collar 27 which is engaged with an enlarged portion of the stem in the form of a projection 28 on the valve stem at its end remote from the head. The diameter of the projection is equal to or slightly less than the diameter of the bore 12 so that the projection 28 can be passed through the bore 12 and also through the bore in the abutment. Beneath the projection there is formed a reduced portion which is assigned the reference numeral 29.

The collar 27 defines a surface 30 which abuts the surface on the spring abutment and in its opposite end surface there is defined a recess 31. Turning now to FIG. 3 the collar 27 has two apertures extending therethrough. The first aperture which is referenced 32, has a diameter such that the projection 28 on the valve stem can be passed therethrough. Moreover, the longitudinal axis of the aperture is off-set from the longitudinal axis of the collar. The collar is provided with a second aperture 33 the axis of the second aperture being aligned with the axis of the collar, the second aperture having a diameter less than the diameter of the projection 28 of the stem. The two apertures connect with each other and a gap is left which is indicated by the letter A in FIG. 3 which is at least equal to but preferably slightly larger than, the diameter of the reduced portion 29 of the stem. It is therefore possible to pass the projection 28 through the aperture 32 and then to slide the collar in a radial direction so that the reduced portion of the stem passes through the gap whereupon axial movement under the action of the spring, of the collar and stem is prevented.

Figure 4:
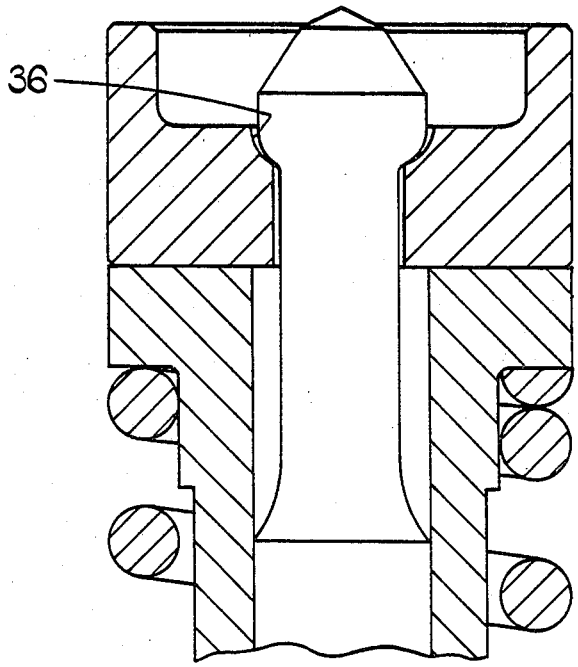
Figure 6:
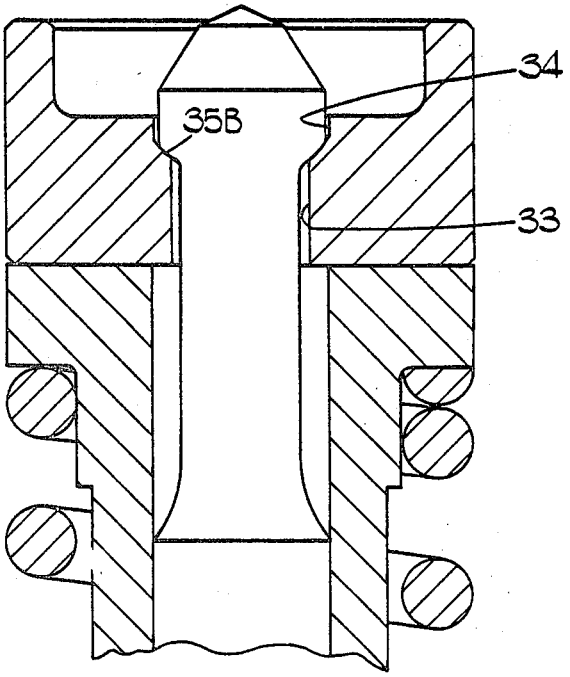

The aperture 33 has an enlarged opening portion 34 which is of larger diameter than the projection 28. The portion 34 in effect forms a further recess into which the projection 28 moves under the action of the spring. A part annular shoulder 35 is defined between the aperture 33 and the enlarged portion 34 thereof. This shoulder is seen in full outline in FIG. 3 and it terminates at the aperture 32. The shoulder may have a convex or a concave surface, an example of a convex surface being shown in FIG. 2 whilst FIGS. 4 and 6 show concave surfaces. The surface of the projection 28 which engages with the shoulder may also have a convex or a concave form, the surface in FIG. 2 being convex. In the examples seen in FIGS. 2 and 6 the enlarged portion 34 of the aperture 33 includes a right cylindrical portion. In FIG. 4 however the enlargement referenced 36, is of part spherical form.

Figure 5:
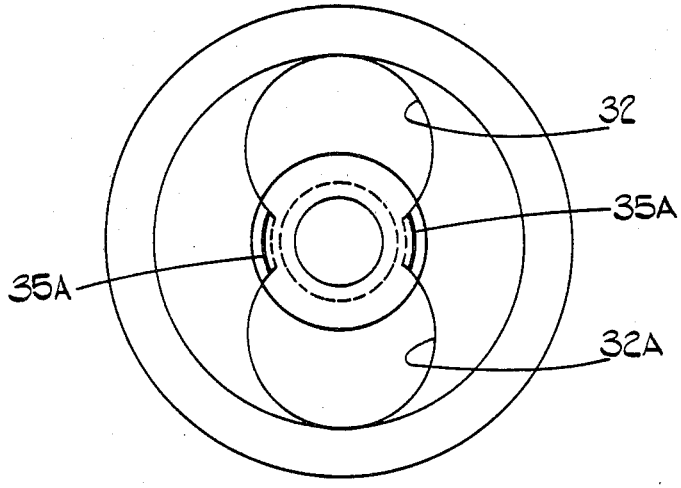
Figure 7:
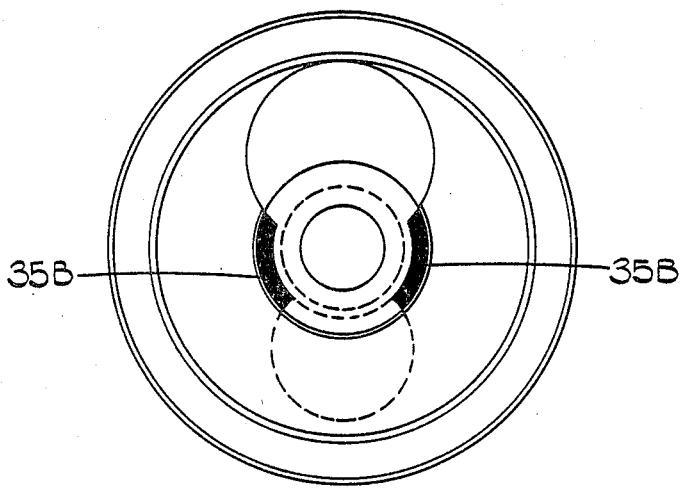

In the example shown in FIGS. 2 and 3, the shoulder 35 extends through substantially more than 180° and a side thrust may be imposed upon the stem 25 of the valve member when in operation. In order to minimise the side thrust and as shown in FIG. 5, a further aperture 32*a* may be formed in the collar diametrically opposite the aperture 32. This has the effect of dividing the shoulder into two portions indicated at 35*a*, which are of the same arcuate length when the aperture 32*a* is the same diameter as the aperture 32, the two portions being substantially diametrically opposite each other. With this arrangement no side thrust as mentioned above will be developed. Alternatively, and as shown in FIG. 7, the shoulder may be divided into two parts 35*b*, by machining away from the shoulder as produced when the apertures 32 and 33 are formed.

It will be understood that once the projection 28 has been located against the shoulder, the collar cannot move in a lateral direction unless the collar is moved axially relative to the projection against the action of the spring.

The constructions described enable the valve assembly to be assembled readily without the need for subsequent machining operations.

I claim:

1. A fuel injection nozzle assembly for use in a fuel injection nozzle for an internal combustion engine, the nozzle assembly comprising a body portion defining a bore having a seating at one end thereof, a valve member having a stem portion extending through the bore, a head located at one end of the stem for cooperation with said seating, a spring abutment located about said stem, a coiled compression spring positioned between said abutment and said body portion, an enlarged portion on the stem, a collar having a first arcuate aperture extending therethrough and through which can pass the enlarged portion of the stem, second and third arcuate apertures intersecting said first aperture, each of said second and third apertures being sized to accommodate a reduced portion of the stem, said apertures defining a gap through which can pass the reduced portion of the stem, said apertures all having different diameters and a part annular shoulder defined by and recessed in said second and third apertures, said shoulder defining a convex surface and being engaged by a surface of convex form defined on said enlaged portion of the stem, said shoulder being divided into two portions, said portions being non-diametrically located on opposite sides of said first aperture, said collar being engaged by said spring abutment whereby the force exerted by the spring acts to maintain said surface in engagement with said shoulder.

* * * * *